US005766054A

United States Patent [19]

Kaihara

[11] Patent Number: 5,766,054

[45] Date of Patent: Jun. 16, 1998

[54] METHOD OF MANUFACTURING CATHODE RAY TUBE

[75] Inventor: Toshio Kaihara, Shiga, Japan

[73] Assignee: NEC Corporation, Tokyo, Japan

[21] Appl. No.: 700,094

[22] Filed: Aug. 20, 1996

[30] Foreign Application Priority Data

Aug. 23, 1995 [JP] Japan ..... 7-214420

[51] Int. Cl.[6] ..... H01J 9/385

[52] U.S. Cl. ..... 445/40; 445/57; 445/73

[58] Field of Search ..... 445/40, 57, 73, 445/6

[56] References Cited

U.S. PATENT DOCUMENTS

| | | | |
|---|---|---|---|
| 4,231,627 | 11/1980 | Schaffernicht et al. | 445/40 |
| 4,406,637 | 9/1983 | Hernqvist | 445/57 |
| 5,201,682 | 4/1993 | Nakagawa et al. | 445/73 |

FOREIGN PATENT DOCUMENTS

| | | | |
|---|---|---|---|
| 54-142882 | 11/1979 | Japan | 445/57 |

*Primary Examiner*—P. Austin Bradley
*Assistant Examiner*—Jeffrey T. Knapp
*Attorney, Agent, or Firm*—Sughure, Mion, Zinn, Macpeak & Seas, PLLC

[57] ABSTRACT

In order to heat a field emission type cold cathode 10 of a cathode ray tube, which generates electron beams, to a temperature high enough to obtain a desired electron emission characteristics of the field emission type cold cathode even when an inner temperature distribution of an evacuating furnace 20, which includes furnace temperature setting heaters 21 and a vacuum pump 23, is not uniform, the field emission type cold cathode 10 of an electron gun 3 of the cathode ray tube, which is provided within a neck portion 2*a* of a bulb 2 of the cathode ray tube, is locally heated by a neck heater 22 detachably mounted on an outer peripheral surface of the neck portion 2*a* while the bulb 2 is being evacuated.

3 Claims, 2 Drawing Sheets

METHOD OF MANUFACTURING CATHODE RAY TUBE

BACKGROUND OF THE INVENTION

1. Field of the Invention

The present invention relates to a method of manufacturing a cathode ray tube having a cold cathode of field-emission type as an electron beam generating source and, particularly, to a method of manufacturing a cathode ray tube, in which a bulb of the cathode ray tube is evacuated while heating a field emission type cold cathode arranged within a neck portion of the bulb.

2. Description of the Related Art

FIG. 1 is a perspective view showing a structure of a field-emission type cold cathode which becomes an electron beam generating source. As shown in FIG. 1, a field emission type cold cathode 10 is constructed with an insulating substrate 11 of such as glass, a first electrode 12 of aluminum, etc., formed on the insulating substrate 11, a resistor layer 13 in the form of a thin silicon film, etc., formed on the first electrode 12, an insulating layer 16 of such as silicon oxide ($SiO_2$) having thickness of 0.5 to 1 μm and formed on the resistor layer 13 and a gate electrode 17 of high melting metal such as tungsten, niobium or molybdenum, etc., or high melting point metal compound having thickness of about 0.2 μm and formed on the insulating layer 16 as a second electrode.

Holes 15 each having diameter of about 1.2 μm are formed through the insulating layer 16 and the gate electrode 17 and, in each hole 15, a sharp conical cathode 14 of high melting point metal such as tungsten or molybdenum, etc., which has a height of 0.5 to 1 μm is formed on the resistor layer 13 so that a cavity 15 having small opening width w is formed around the conical cathode 14 in the insulating layer 16 on the resistor layer 13. Therefore, the cathodes 14 oppose to the gate electrode 17 through the cavities 15 and, by applying a voltage of, in this case, several tens to about 100 volts between the gate electrode 17 and the cathodes 14, it is possible to emit electrons from the cathodes 14 without heating them.

Incidentally, there is another field emission type cold cathode which has a structure in which cathodes are formed directly on an electrically conductive substrate without using the first electrode and the resistor layer of the above mentioned field emission type cold cathode 10.

In the field emission type cold cathode 10, it is very important that electron emitted from the cathodes 14 is stable. In order to maintain electron emitted from the cathode 14 stable, the manufacturing method of the field emission type cold cathode 10 includes the so-called aging step, that is, the step of emitting a required amount of electron within a predetermined time period.

FIG. 2 shows schematically a structure of a cathode ray tube 1 having the field emission type cold cathode 10 as its electron beam source.

As shown in FIG. 2, the cathode ray tube 1 includes a bulb 2 having a neck portion 2*a* in which an electron gun 3 having the field emission type cold cathode 10 is arranged, a fluorescent screen and a shadow mask in a case of a color cathode ray tube, etc. Since the constructive components except the field emission type cold cathode 10 are well known, detailed description thereof are omitted. Briefly, the electron gun 3 is constructed with an anode 4 connected to an anode terminal 4*a*, a focusing electrode 5, a control electrode 6 and the field emission type cold cathode 10.

Although not described in detail, the manufacturing process of the cathode ray tube 1 includes the step of shielding the bulb, the step of sealing the bulb and the step of evacuating the bulb, in that order. FIG. 3 schematically shows a facility for evacuating the cathode ray tube 1.

As shown in FIG. 3, heaters 21 are arranged on opposite inner walls of an evacuating furnace 20 to maintain an interior of the furnace 20 at a predetermined temperature. After the sealing step, the cathode ray tube 1 is transported by a moving hanger to pass through the furnace 20. In a state where the cathode ray tube 1 is in the furnace 20, an evacuating pipe 7 of the bulb 2 of the cathode ray tube 1 is connected to one end of a pipe 24 having the other end connected to a vacuum pump 23 and the bulb 2 is evacuated by the latter.

It has been generally known that, when the field emission type cold cathode 10 is overheat-treated at a temperature of 400° C. or higher, the emitter characteristics are improved since undesired oxide formed on a surface of the emitter thereof is dissociated and work function of the emitter is reduced.

As mentioned above, the field emission type cold cathode 10 used as the cathode of the electron gun 3 of the cathode ray tube 1 must have an improved emission characteristics since the bulb 2 is evacuated and heat-treated in the furnace 20. However, in the described manufacturing method of the cathode ray tube 1, the temperature distribution within the furnace 20 is not uniform and so the field emission type cold cathode 10 which produces electron beams is not heated sufficiently. That is, the field emission type cold cathode 10 can not be heated to a temperature high enough to obtain a good emission characteristics.

SUMMARY OF THE INVENTION

An object of the present invention is to provide a method of manufacturing a cathode ray tube having an improved emission characteristics.

The above object can be achieved according to the present invention by providing means for sufficiently heating a field emission type cold cathode so that the latter can efficiently produce electrons.

The method of manufacturing the cathode ray tube, according to the present invention, is featured by the use of an evacuating furnace having heaters for setting a temperature of an interior of the furnace at a desired temperature and a vacuum pump and the means for heating a field emission type cold cathode arranged in a neck portion of a bulb of the tube.

The means for heating the field emission type cold cathode may comprise a neck heater detachably mounted on an outer periphery of the neck portion of the bulb.

In the method according to the present invention, the bulb is evacuated while the field emission type cold cathode disposed in an interior of the neck portion of the bulb is heated by the neck heater.

BRIEF DESCRIPTION OF THE DRAWINGS

Other objects, features and advantages of the present invention will become more apparent from the following detailed description of preferred embodiments in conjunction with the accompanying drawings, in which.

DETAILED DESCRIPTION OF THE PREFERRED EMBODIMENTS

An embodiment of the present invention will be described with reference to FIG. 4 which shows schematically a device to be used in an evacuation process for evacuating a bulb of a cathode ray tube, according to the present invention.

Figure 4:
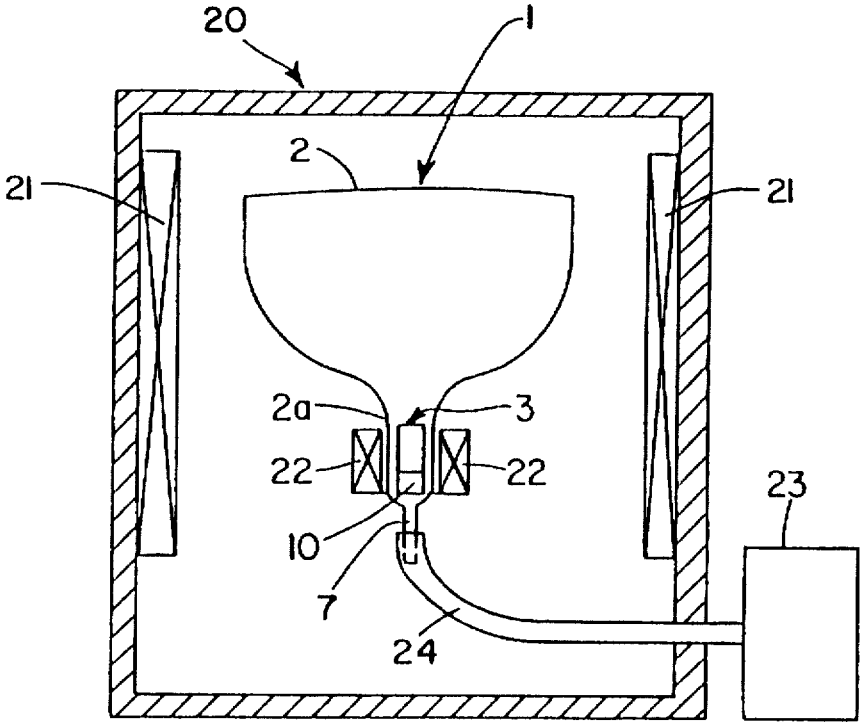
FIG. 4 shows schematically a device to be used for evacuating a cathode ray tube according to the present invention.

In FIG. 4, a reference numeral 1 denotes a cathode ray tube, 2 a bulb, 2*a* a neck portion of the bulb 2, 3 an electron gun and 10 a field emission type cold cathode of the electron gun 3 for generating electron beams. A reference numeral 20 denotes an evacuating furnace, 21 heaters for setting temperature on an interior of the furnace, 22 a detachable neck heater and 23 a vacuum pump. The detachable neck heater 22 comprises a pair of halves which, when assembled on a neck portion 2*a* of the bulb 2, becomes an annular heater.

The cathode ray tube 1 uses the field emission type cold cathode 10 as a cathode of the electron gun 3. When the cathode ray tube 1 is a color cathode ray tube, three of the field emission type cold cathodes 10 are used.

As in the prior art, the cathode ray tube 1 is manufactured through a shielding step, a sealing step and an evacuating step. FIG. 4 shows the cathode ray tube 1 in the evacuating step.

As shown in FIG. 4, the feature of the present invention resides in that, in the evacuating step, the field emission type cold cathode 10 of the electron gun 3 is sufficiently heated by the neck heater 22 provided on an outer peripheral surface of the neck portion 2*a* of the bulb 2. The detachable neck heater 22 is mounted on the neck portion 2*a* of the bulb 2 of the cathode ray tube 1 while being transported by a moving hanger from a place in which the sealing step preceding the evacuating step is performed. Then, an evacuating pipe 7 extending from the neck portion 2*a* of the bulb 2 is connected to a piping 24 and the bulb 2 is further transported into the evacuating furnace 20 inner temperature of which is controlled by heaters 21. In the furnace 20, the bulb 2 is evacuated by the vacuum pump 23.

Figure 1:
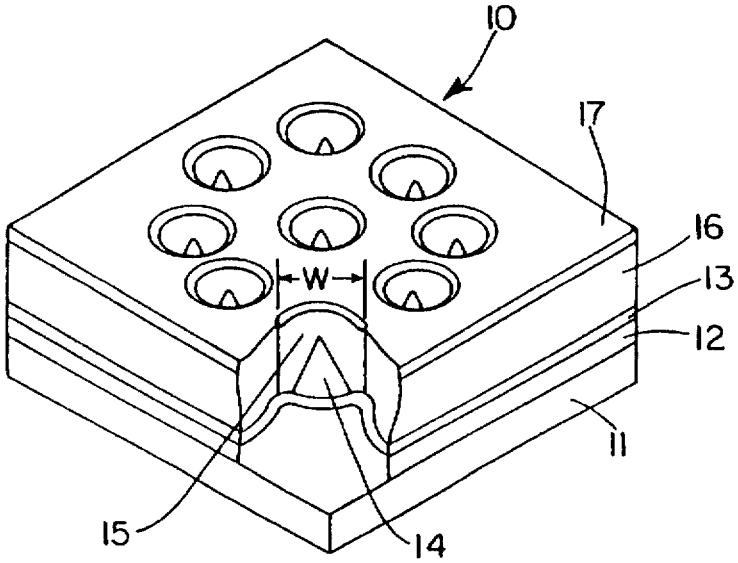
FIG. 1 PRIOR ART
FIG. 1 is a perspective view showing a conventional field emission type cold cathode.
Figure 2:
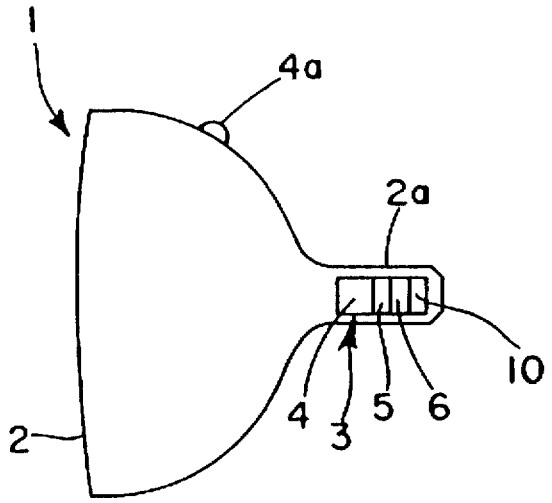
FIG. 2 PRIOR ART
FIG. 2 shows schematically a cathode ray tube having a conventional field emission type cold cathode.
Figure 3:
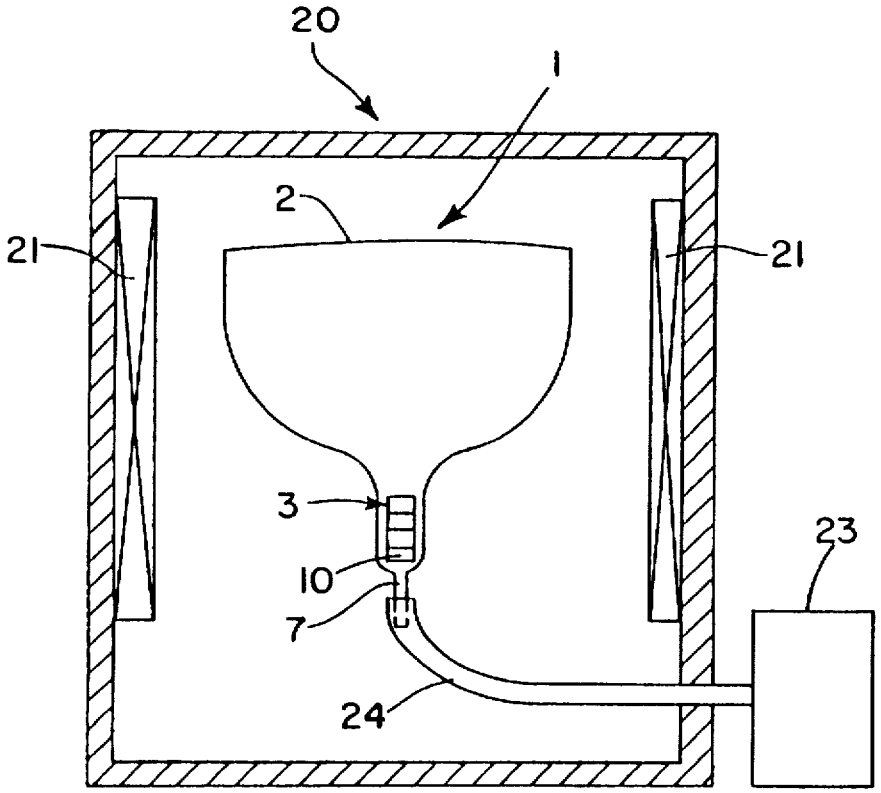
FIG. 3 PRIOR ART
FIG. 3 shows schematically a main portion of a device to be used for evacuating a conventional cathode ray tube.

In this manner, the cathode ray tube 1 passes through the evacuating furnace 20 inner temperature of which is maintained the heaters 21 at 400° C.~500° C. for a time period from 2.5 to 3.5 hours. During the cathode ray tube 1 is passing through the furnace 20, the electron gun 3 of the cathode ray tube 1, that is, the field emission type cold cathode 10, is heated to 400° C. or higher which is high enough to clean the cathode 14 shown in FIG. 1 in a reduced pressure.

As described, according to the present invention, the manufacturing method of the cathode ray tube comprises, in addition to the conventional steps, the step of heating the neck portion of the bulb 2 by mounting the neck heater on the outer peripheral surface of the neck portion. Therefore, even if the temperature distribution within the evacuating furnace obtained by only the heaters 21 is not uniform, the field emission type cold cathode of the electron gun can be heated to a temperature high enough to clean the cathode to thereby realize a preferable electron emission characteristics. That is, a cathode ray tube having the field emission type cold cathode which has a desired electron emission characteristics as the electron beam generating source can be provided.

What is claimed is:

1. A method of manufacturing a cathode ray tube including a field emission type cold cathode as an electron beam source, comprising a step of heating the cathode ray tube as a whole and a step of locally heating the field emission type cold cathode provided in a neck portion of a bulb of the cathode ray tube.

2. A method claimed in claim 1, wherein the step of locally heating is performed by a neck heater detachably mounted on an outer peripheral surface of the neck portion of the bulb.

3. A method claimed in claim 1, wherein the bulb of the cathode ray tube is evacuated during the step of locally heating.

* * * * *